US011543178B2

(12) United States Patent
Morgan et al.

(10) Patent No.: US 11,543,178 B2
(45) Date of Patent: Jan. 3, 2023

(54) INSULATED COOLER WITH A SUBMERSIBLE INTERNAL CIRCULATING PUMP

(71) Applicants: David Morgan, Nederland, TX (US); Paul Bernard, Nederland, TX (US)

(72) Inventors: David Morgan, Nederland, TX (US); Paul Bernard, Nederland, TX (US)

( * ) Notice: Subject to any disclaimer, the term of this patent is extended or adjusted under 35 U.S.C. 154(b) by 0 days.

(21) Appl. No.: 17/354,630

(22) Filed: Jun. 22, 2021

(65) Prior Publication Data

US 2021/0396462 A1 Dec. 23, 2021

Related U.S. Application Data

(60) Provisional application No. 63/042,689, filed on Jun. 23, 2020.

(51) Int. Cl.

| | |
|---|---|
| ***F25D 31/00*** | (2006.01) |
| ***F25D 3/08*** | (2006.01) |
| ***F25D 23/06*** | (2006.01) |
| ***F25D 17/02*** | (2006.01) |

(52) U.S. Cl.

CPC ..... *F25D 31/007* (2013.01); *F25D 3/08* (2013.01); *F25D 17/02* (2013.01); *F25D 23/061* (2013.01); *F25D 2303/0845* (2013.01); *F25D 2331/804* (2013.01)

(58) Field of Classification Search

CPC ..... F25D 31/007; F25D 3/08; F25D 17/02; F25D 23/061; F25D 2331/804; F25D 3/06; F25D 11/003; F25D 29/003; F25D 29/005; F25D 31/002; F25D 23/003

See application file for complete search history.

(56) References Cited

U.S. PATENT DOCUMENTS 2,214,009 A * 9/1940 Boester, Jr. ..... F25D 17/02 62/434
2,618,134 A * 11/1952 Kaufman ..... F25D 17/02 68/262 R
3,049,890 A * 8/1962 Ruppel ..... A23B 4/066 62/240

(Continued)

FOREIGN PATENT DOCUMENTS

KR 20100103977 A * 9/2010 ..... A47B 31/02

*Primary Examiner* — Emmanuel E Duke
(74) *Attorney, Agent, or Firm* — Boudwin Intellectual Property; Daniel Boudwin

(57) ABSTRACT

An insulated cooler with a submersible internal circulating pump is provided. The insulated cooler includes a base, a plurality of sidewalls extending upwardly therefrom, and an open upper end defining an interior volume. The insulated cooler further includes a lid that is removably secured over the open upper end, wherein the lid includes multiple recessed cup holders with sidewalls that extend downwardly into the interior volume of the insulated cooler. The insulated cooler includes a submersible internal circulating pump operably connected to a system of copper tubing that winds around the sidewall of the recessed cup holders. When activated, the submersible internal circulating pump transports melted ice water through the tubing, which cools the sidewall of the recessed cup holders. In this way, the insulated cooler can cool objects within the interior volume and can cool beverages that are supported within the exterior cup holders.

13 Claims, 6 Drawing Sheets

(56) References Cited

U.S. PATENT DOCUMENTS

| | | | | |
|---|---|---|---|---|
| 3,974,658 | A * | 8/1976 | Starrett | F25D 3/00 220/62.12 |
| 4,910,976 | A * | 3/1990 | Drummond, III | F25D 31/007 62/1 |
| 8,516,849 | B2 * | 8/2013 | Mooijer | F25D 17/02 62/457.5 |
| 8,631,665 | B1 | 1/2014 | DeClementi | |
| 10,107,548 | B2 | 10/2018 | Mize et al. | |
| 10,914,515 | B2 * | 2/2021 | Deisley | F25D 31/007 |
| 2002/0124591 | A1 * | 9/2002 | Gano, III | B65D 77/0486 62/457.5 |
| 2008/0178629 | A1 * | 7/2008 | Meether | F25D 3/08 220/592.2 |
| 2011/0030413 | A1 | 2/2011 | Heil | |
| 2013/0233002 | A1 | 9/2013 | Donaldson et al. | |
| 2017/0089630 | A1 * | 3/2017 | Jayaram | F25D 31/007 |
| 2018/0080706 | A1 * | 3/2018 | Mize | F25D 17/02 |
| 2019/0161952 | A1 * | 5/2019 | Muhi Deen | E03D 9/085 |
| 2021/0364218 | A1 * | 11/2021 | Schlotterback | F25D 17/02 |

* cited by examiner

INSULATED COOLER WITH A SUBMERSIBLE INTERNAL CIRCULATING PUMP

CROSS REFERENCE TO RELATED APPLICATIONS

This application claims the benefit of U.S. Provisional Application No. 63/042,689 filed on Jun. 23, 2020. The above identified patent application is herein incorporated by reference in its entirety to provide continuity of disclosure.

BACKGROUND OF THE INVENTION

The present invention relates to an insulated cooler. More specifically, the present invention provides an insulated cooler with a submersible internal circulating pump that is operably connected to a copper tubing that coils about multiple recessed cup holders. In this manner, the copper tubing delivers cooled liquid to coils to keep beverages placed within the recessed cup holder cold via a heat transfer process.

Coolers are commonly used by individuals during recreational activities. The cooler allows the individual to easily transport food and beverages to the desired locations. Specifically, the individual may fill the cooler with ice to keep the food and beverages cold throughout the duration of the transportation and the recreational activities. During the consumption of a beverage, the beverage can gradually become warm, especially when the individual is consuming the beverage outside in warm temperatures. This can leave the consumer having to drink a beverage at an undesirable temperature.

Many standard coolers include recessed cup holders molded into the lid. The cup holders in the standard coolers allow an individual to keep an active beverage within reach while they are near the cooler. While the beverages are placed outside of the interior of the cooler, the beverage will fail to maintain the desired consumption temperature. This will leave the beverage at an undesirable consumption temperature for the individual. An individual might prematurely discard of the beverage because the temperature of the beverage often affects the quality of the beverage.

Within the standard coolers, individuals must place ice into the interior volume of the cooler in order to ensure the contents of the cooler remain cold. While within the standard coolers, the ice may begin to melt resulting in the creation of excess water within the interior volume of the cooler. Often that water provides no additional function for the individual. This water created from the melted ice is usually discarded. Moreover, the individual will drain the water from the interior volume of the cooler to prevent the contents of the cooler from becoming oversaturated with the water. Providing an alternative use of that water will limit the wastefulness of discarding of the water.

Therefore, there is a defined need amongst the known prior art references for a cooler with a submersible internal circulating pump that transports water resulting from the melting ice within the cooler into copper tubing that coils about multiple recessed cup holders In this way, a beverage placed into a recessed cup holder may be maintained at a consumable temperature.

SUMMARY OF THE INVENTION

In view of the foregoing disadvantages inherent in the known types of coolers now present in the known art, the present invention provides a new insulated cooler with a submersible internal circulating pump operably connected to copper tubing that delivers cooling liquid to chill beverages placed within a recessed cup holder.

It is therefore an object of the present invention to provide alternative use of the water that is produced from melting ice within a cooler. Typically, the water from the melted ice builds up within the cooler because there is no alternative use for it in the cooler. As a result, a user will discard of the water within a cooler. The discarding of the water is quite wasteful. The present invention will utilize the water that is created from the ice melting within the cooler and repurpose the water to provide a useful function. The alternative purpose of the water in the present invention is to provide a cold liquid that will be pumped through a copper tubing that can allow for a beverage placed within a recessed cup holder, disposed on the cooler's lid, to remain cold while the beverage is being consumed.

Another aspect of the present invention is the plurality of recessed cup holders that can maintain the temperature of a cold beverage. When using a cooler, users will often have placed their beverage on a surface. To prevent the beverage from falling off a surface, the user will place the beverage into a recessed cup holder. While placed therein, a cold beverage will rise in temperature. This will result in the beverage rising to an undesired consumption temperature and leave the consumer reluctant to consume the beverage. Thus, providing users with an insulated cooler that continuously cools the beverages placed into a recessed cup holder will allow the user to prevent the beverage from falling off a surface without sacrificing the quality of the beverage. Ultimately, this provides the user with a beverage that is maintained at a desired consumption temperature for a prolonged time.

Yet another aspect of the present invention is the submersible internal circulating pump operably connected to a copper tubing that delivers a cooling liquid. For the melted ice water to properly cool the beverages in the recessed cup holder, it needs to be transported about the individual recessed cup holders. For the water within the interior volume of the cooler to be transported to the recessed cup holders disposed on the cooler's lid, while not having the temperature of the water drastically raise, a submersible internal circulating pump will propel the water up towards the cooler's lid. To prevent the water from raising in temperature prior to reaching the recessed cup holder, the submersible internal circulating pump will deliver the water through the copper tubing. Copper has a high thermal conductivity. That makes copper an effective heat exchanger for thermal water systems. This allows the cold water that is pumping through the copper tubing to remove the heat from the beverage that it coils around in the recessed cup holders. The copper tubing will permit the heat transfer to commence between the cold water and the beverage place within the recessed cup holder. The transfer of heat from the beverage to the cold water within the copper tubing will allow for the beverage to remain cold.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
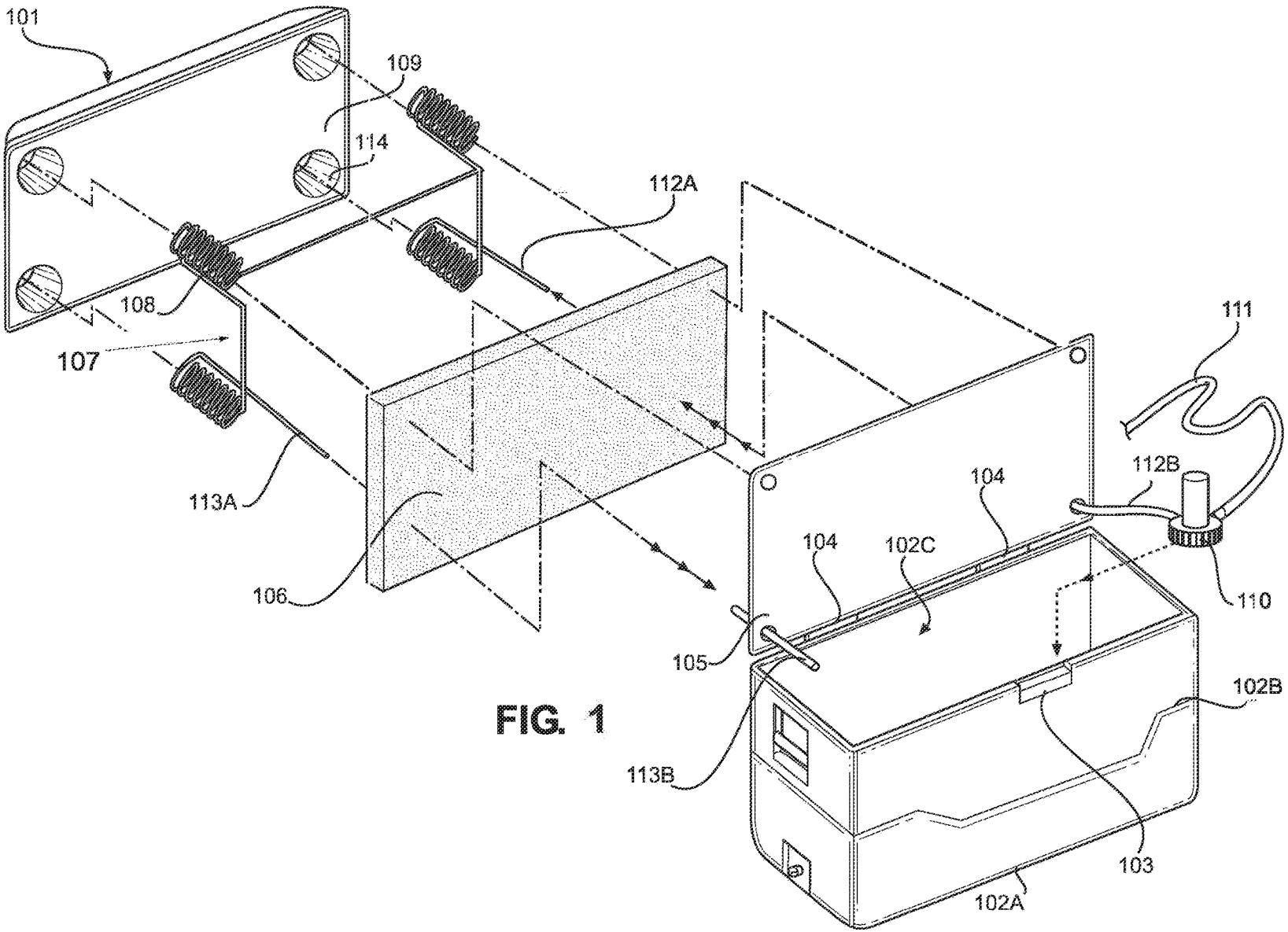
FIG. 1 shows an exploded view of an embodiment of the insulated cooler with a submersible internal circulating pump.

Reference is made herein to the attached drawings. Like reference numerals are used throughout the drawings to depict like or similar elements of the insulated cooler with a submersible internal circulating pump. For the purposes of presenting a brief and clear description of the present invention, the preferred embodiment that will be discussed is the cooler with a single submersible internal circulating pump. The figures are intended for representative purposes only and should not be limiting in any respect.

FIG. 1 shows an exploded view of an embodiment of an insulated cooler with a submersible internal circulating pump. The insulated cooler 101 comprises a base 102A, a plurality of sidewalls 102B, and an open upper end. The plurality of sidewalls 102B are extending upwardly from the base 102A, defining an interior volume 102C. A lid is secured to at least one of the sidewalls 102B by a plurality of fasteners 104. In this embodiment, the plurality of fasteners 104 are hinges. Moreover, the lid can be secured to the plurality of sidewalls 102B by a locking mechanism 103. In this embodiment, the locking mechanism 103 is a latch.

The lid further comprises of an inner lid 105, an outer lid 109, and a thermally insulated foam interior body 106. The inner lid 105 has a top face and a bottom face. The thermally insulated foam interior body 106 has a top face and a bottom face. The outer lid 109 has a top face and a bottom face. The top face of the thermally insulated foam interior body 106 is disposed on the bottom face of the outer lid 109. The top face of the inner lid 105 is disposed on the bottom face of the thermally insulated foam interior body 106. In this way, the thermally insulated foam interior body 106 is sandwiched between the inner lid 105 and the outer lid 109. When the lid is coupled with the plurality of sidewalls 102B, the bottom face of the inner lid 105 is disposed over the open end of the interior volume 102C.

The outer lid 109 further comprises a plurality of recessed cup holders 114. The plurality of recessed cup holders 114 further comprises sidewalls that extend downwardly from the outer lid 109 into the thermally insulated foam interior body 106. The thermally insulated foam interior body 106 prevents any undesired heat transfer from occurring. When the lid is secured to the plurality of sidewalls 1028, a beverage may be placed within one of the recessed cup holders 114.

A system of copper tubing 107 is integrated into the lid. The system of copper tubing 107 enters through the inner lid 105 and into the bottom face of the thermally insulated foam interior body 106. The thermally insulated foam interior body 106 prevents the system of copper tubing 107 from undesired heat transfer. The system of copper tubing 107 further includes a plurality coiled copper tubing 108. The system of copper tubing 107 further comprises a copper intake tube 112A and a copper discharge tube 113A. In the shown embodiment of the system of copper tubing 107 is a single length of tubing. the system of copper tubing 107 begins at the copper intake tube 112A. The copper intake tube 112A is connected to a first coiled copper tubing. The first coiled copper tubing is connected to a second coiled copper tubing. The second coiled copper tubing is connected to a third coiled copper tubing. The third coiled copper tubing is connected to a final coiled copper tubing. The final coiled copper tubing is connected to the copper discharge tube 113A.

The coiled copper tubing 108 encircles the sidewall of each recessed cup holders 114. The copper intake tube 112A is operably connected to a submersible internal circulating pump 110 via an intake hose 112B. The submersible internal circulating pump 110 will pump liquid from the interior volume 102C into the intake hose 112B. The submersible internal circulating pump 110 includes a power cord 111. The power cord 111 supplies power to the submersible internal circulating pump 110. The liquid will enter the system of copper tubing 107 via the copper intake tube 112A. The submersible internal circulating pump 110 will pump the liquid to travel throughout the system of copper tubing 107. The liquid will exit the system of copper tubing 107 by the copper discharge tube 113A. The copper discharge tube 113A is operably connected to a discharge hose 113B. The discharge hose 113B will eject the liquid into the interior volume 102C.

Figure 2:
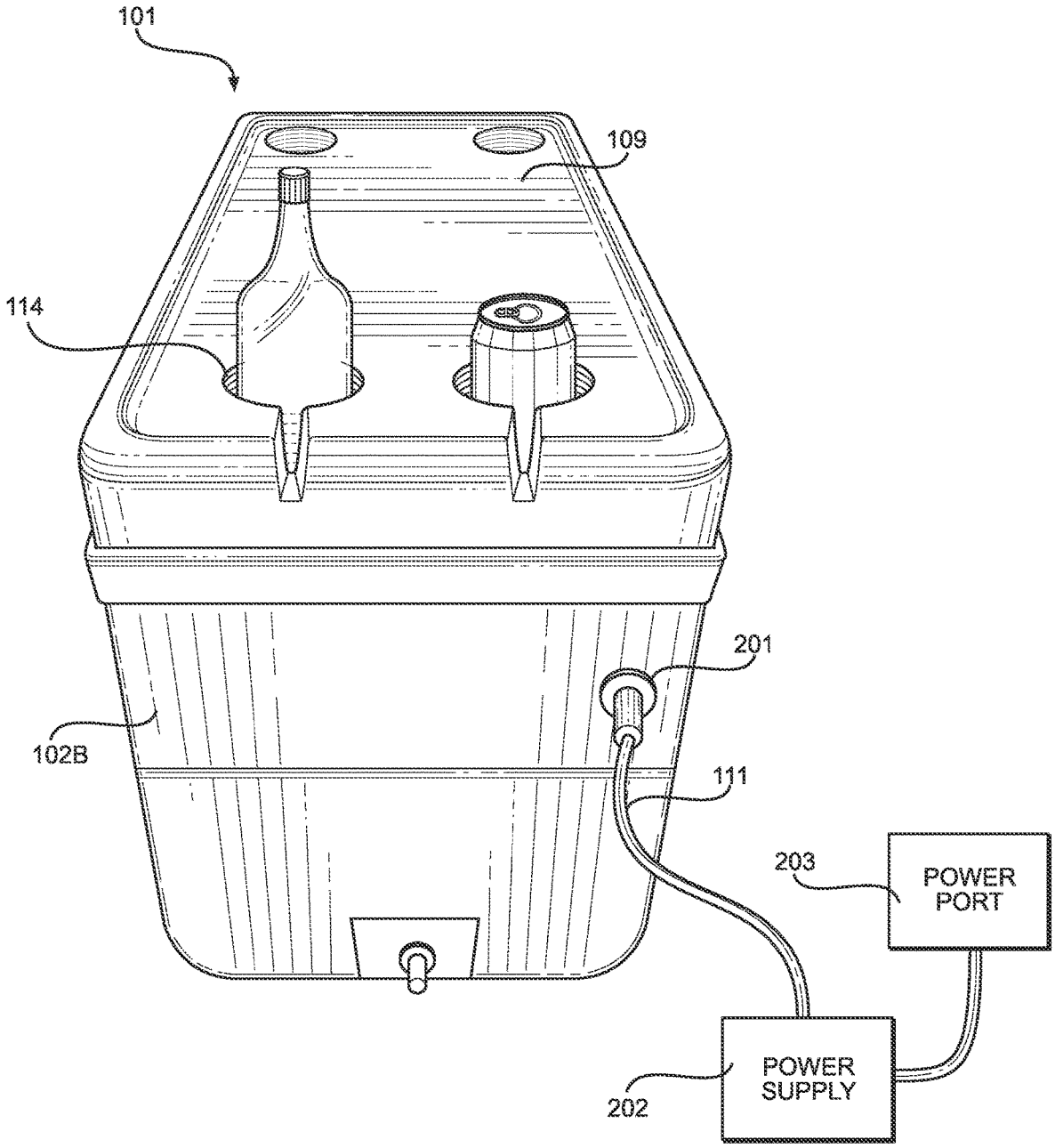
FIG. 2 shows an external side view of an embodiment of the insulated cooler with a submersible internal circulating pump.

FIG. 2 shows an external side view of an embodiment of an insulated cooler with a submersible internal circulating pump. When the lid of the insulated cooler 101 is connected to the plurality of sidewalls 102B, a user may access the plurality of recessed cup holders 114 that downwardly extend into the outer lid 109 and the thermally insulated foam interior body. A user may insert a can or a bottle into the plurality of recessed cup holders 114. The can or bottle may be easily removed from the plurality of recessed cup holders 114. An aperture 201 is disposed on one of the sidewalls 102B. The power cord 111 connected to the submersible internal circulating pump is inserted into the aperture 201. The power cord 111 connects the submersible internal circulating pump to the power supply 202. In this embodiment of the insulated cooler 101, the power supply 202 is a portable battery. Moreover, a power port 203 is operably connected to the power supply 202. The power port 203 enables a user to connect an electronic device and other devices to the power supply 202.

Figure 3:
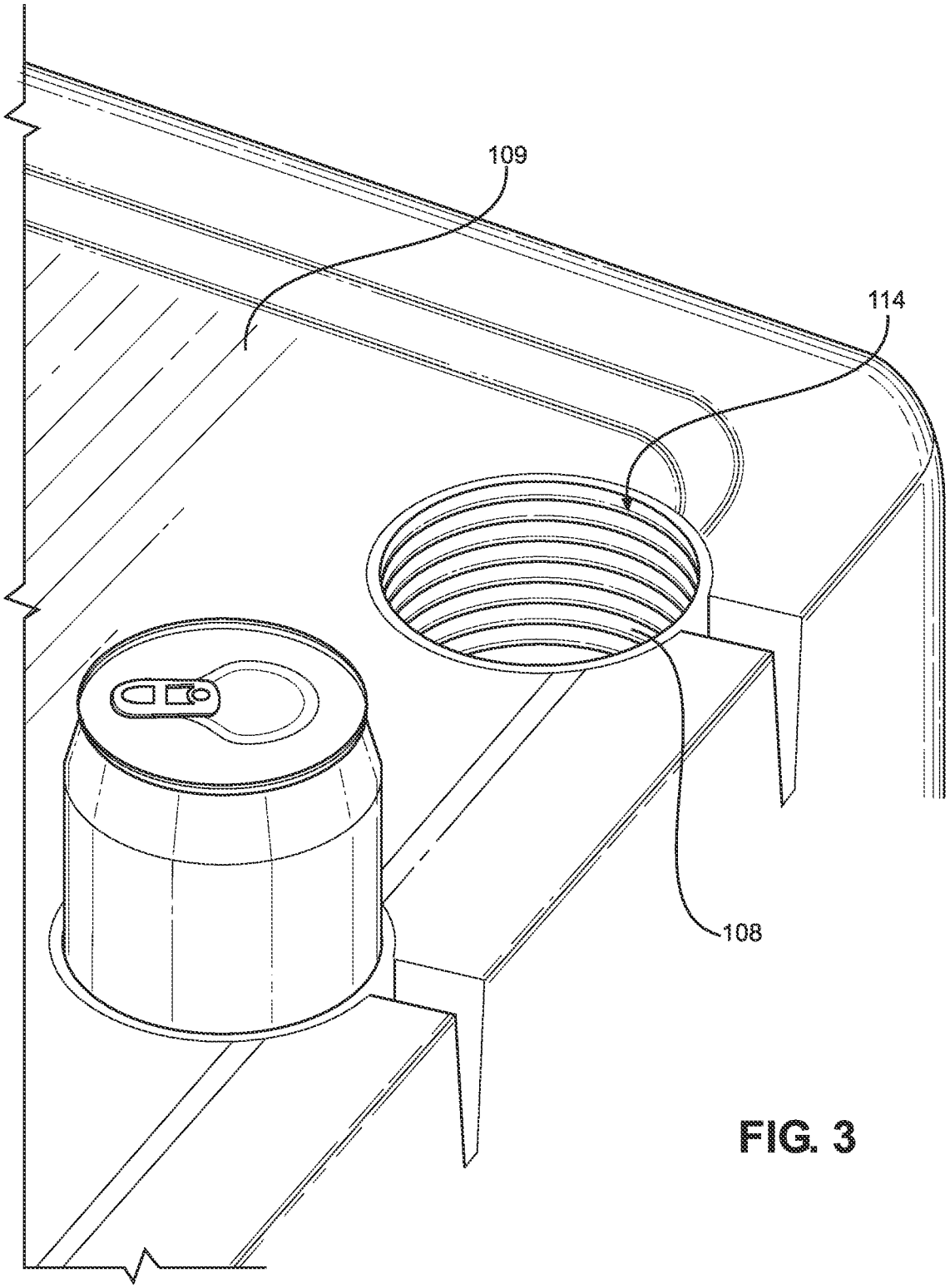
FIG. 3 shows a close-up external top view of an embodiment of the insulated cooler with a submersible internal circulating pump.

FIG. 3 shows a close-up external top view of an embodiment of an insulated cooler with a submersible internal circulating pump. The plurality of recessed cup holders 114 downwardly extend into the outer lid 109. The plurality of recessed cup holders 114 may be used when the lid of the insulated cooler is secured to the plurality of sidewalls. The plurality of recessed cup holders 114 will be encircled by the coiled copper tubing 108. The coiled copper tubing 108 is connected to the system of copper tubing. When the liquid is inserted into the system of copper tubing, the liquid will travel to the coiled copper tubing 108.

The copper tubing has the properties for a thermally efficient and effective heat exchanger. In a heat exchanger, when at least two objects are in thermal contact with one another, the heat will flow from a hotter object to a colder object until the objects reach thermal equilibrium. The thermally insulated foam interior body prevents the system of copper tubing from acting as a heat exchanger. Thus, when a cooled liquid is within the system of copper tubing, the thermally insulated foam interior body will allow the cooled liquid to maintain its temperature. The interior of the coiled copper tubing 108, however, is exposed and not encased in the thermally insulated foam interior body. Therefore, the coiled copper tubing 108 may utilize the properties of copper tubing to act as a thermally efficient and effective heat exchanger. When a user inserts a can or bottle into a recessed cup holder 114, the coiled copper tubing 108 will be in direct thermal contact with the can or bottle. With the can or bottle inserted into a recessed cup holder 114, as the cooled liquid travels into the coiled copper tubing 108, the coiled copper tubing 108 may act as a heat exchanger. As a heat exchanger, the heat within the can or bottle will flow into the cooled liquid via the coiled copper tubing 108, until the can or bottle and the cooled liquid reach thermal equilibrium. This thermodynamic process will allow the beverage within the can or bottle to maintain a desired cooled temperature. As the cooled liquid within the coiled copper tubing 108 continues through the system of copper tubing, the cooled liquid will reenter the interior volume of the insulated cooler.

Figure 4:
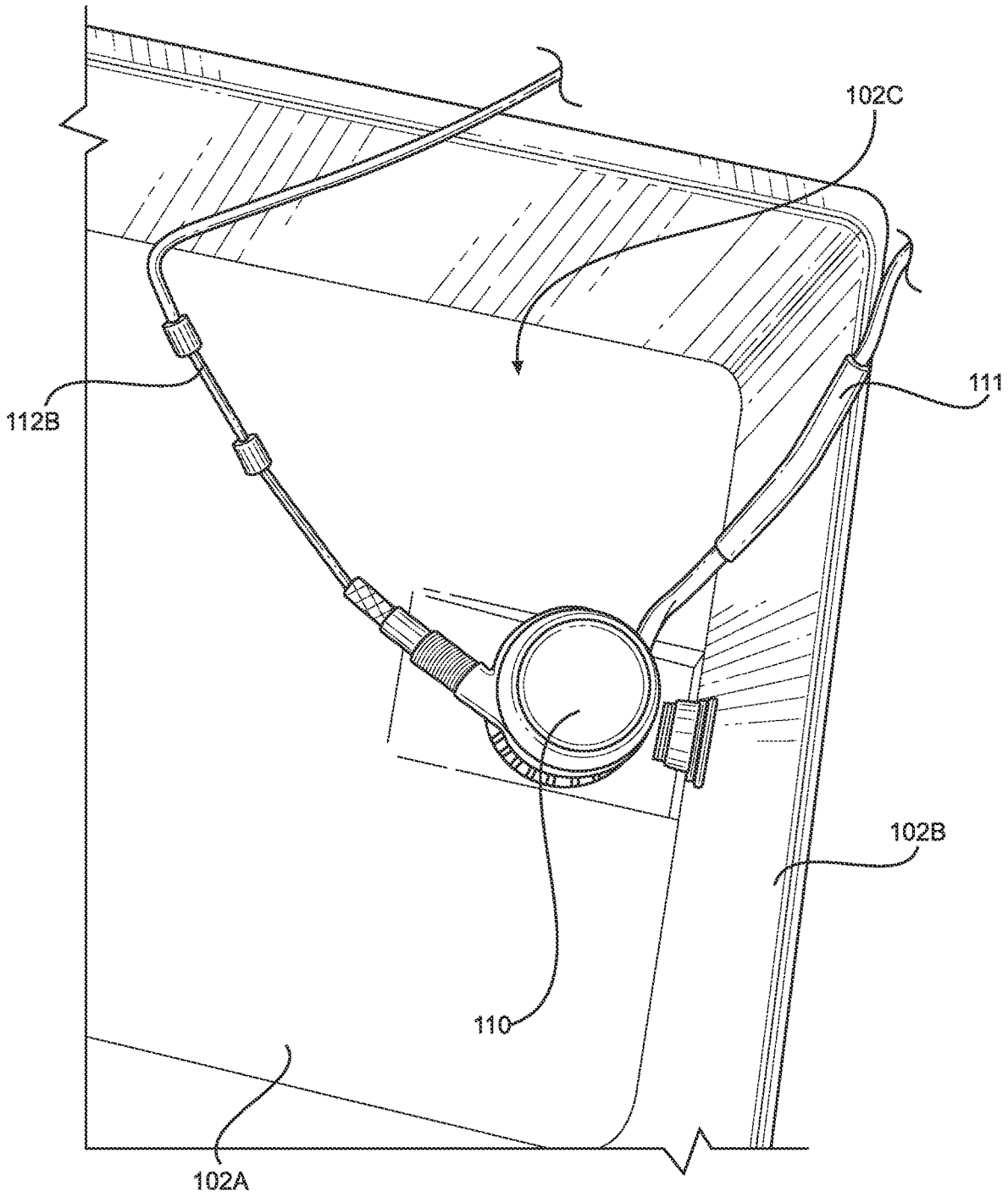
FIG. 4 shows an internal view of an embodiment of the insulated cooler with a submersible internal circulating pump.
Figure 5:
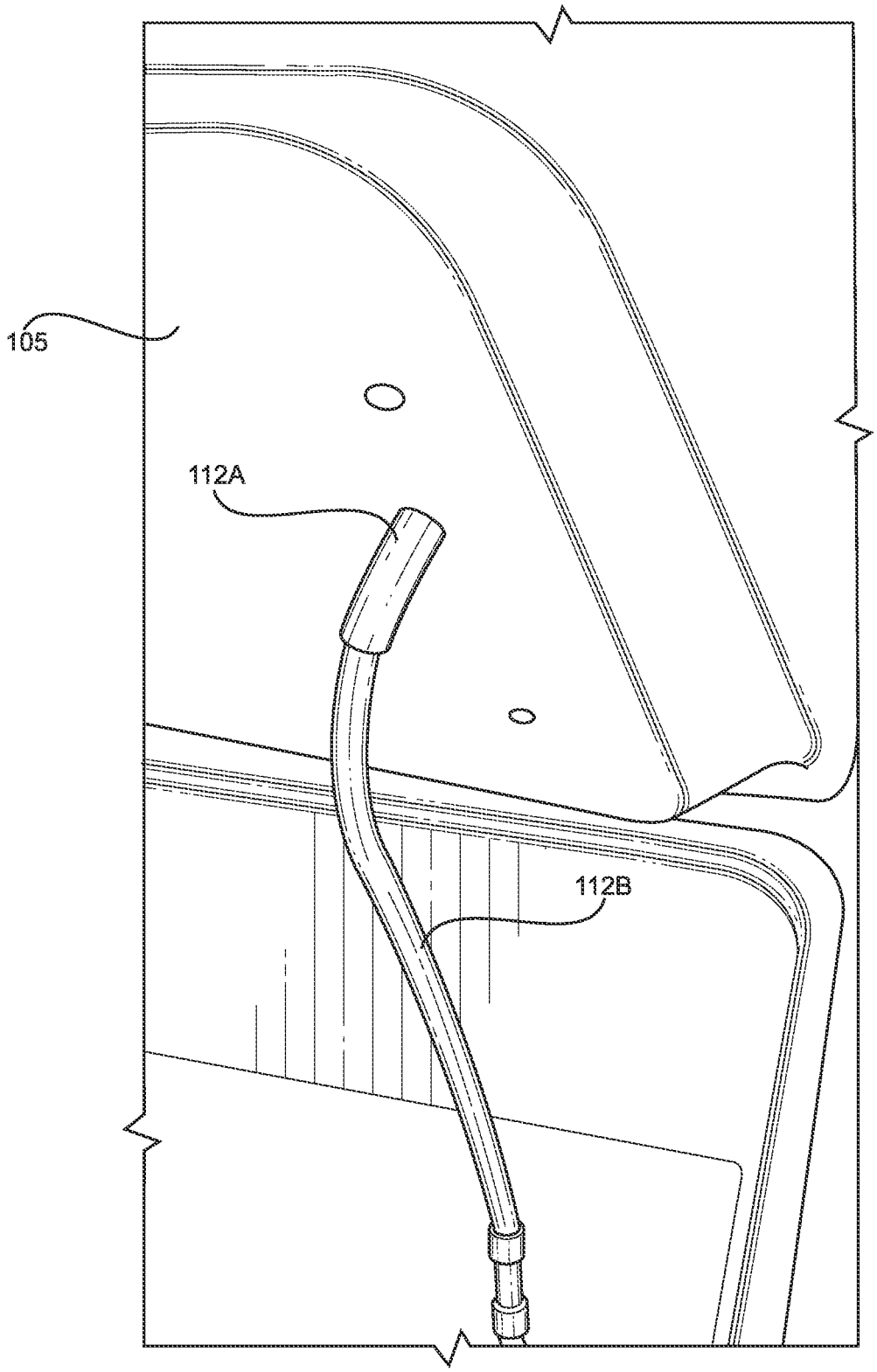
FIG. 5 shows an internal view of an embodiment of the insulated cooler with a submersible internal circulating pump.

FIG. 4 shows an internal view of an embodiment of an insulated cooler with a submersible internal circulating pump. The submersible internal circulating pump 110 is secured to the base 102A of the insulated cooler towards one of the sidewalls 102B. The power cord 111 is connected to the submersible internal circulating pump 110. When the interior volume 102C contains a liquid, the liquid enters the submersible internal circulating pump 110. In common uses of the insulated cooler, the liquid is the water that melts from ice placed within the interior volume 102C. The submersible internal circulating pump 110 will direct the liquid into an intake hose 112B. The submersible internal circulating pump 110 will be able to continuously pump the liquid into the intake hose 1128, while the submersible internal circulating pump 110 is being supplied power FIG. 5 shows an internal view of an embodiment of an insulated cooler with a submersible internal circulating pump. The intake hose 1128 is operably connected to a copper intake tube 112A. The copper intake tube 112A is located on the bottom face of the inner lid 105. The copper intake tube 112A is further connected to the system of copper tubing. When the liquid is pumped into the intake hose 1128, via the submersible internal circulating pump, the liquid will enter the system of copper tubing through the copper intake tube 112A. The submersible internal circulating pump will transport the liquid throughout the entire system of copper tubing.

Figure 6:
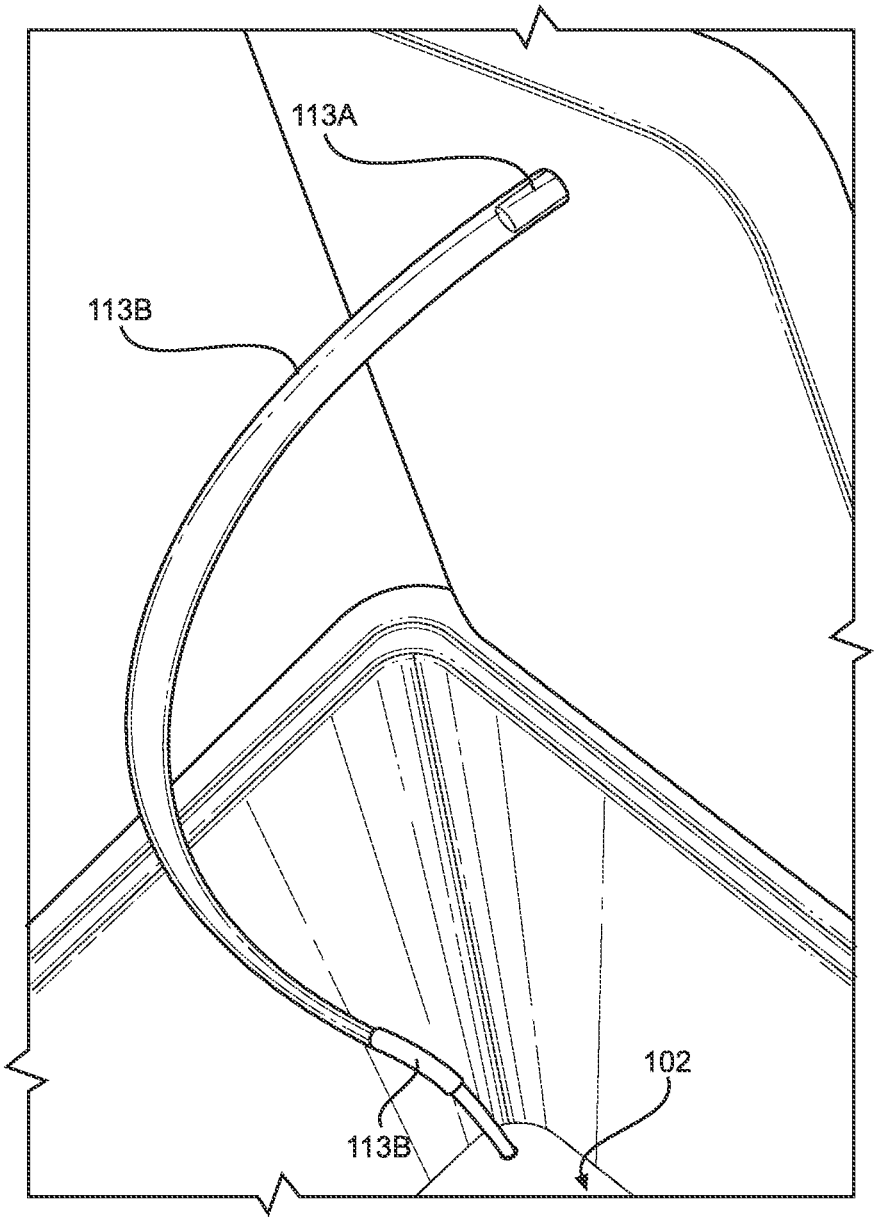
FIG. 6 shows an internal view of an embodiment of the insulated cooler with a submersible internal circulating pump.

FIG. 6 shows an internal view of an embodiment of an insulated cooler with a submersible internal circulating pump. When the liquid has passed through the entire system of copper tubing, the liquid will reach a copper discharge tube 113A. The copper discharge tube 113A is operably connected to a discharge hose 1138. When the liquid is discharged from the system of copper tubing via the copper discharge tube 113A, the liquid will pass through the discharge hose 113B. When the liquid is released from the discharge hose 113B, it will enter the interior volume 102C of the insulated cooler. When the liquid is in the interior volume 102C it can cool and return to the system of copper tubing, via the submersible internal circulating pump.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cooler, comprising:

a base;

a plurality of sidewalls extending upwardly from the base;

wherein the plurality of sidewalls terminates in an open upper end, defining an interior volume;

a lid removably securable to the open upper end;

wherein the lid comprises an inner lid, an outer lid, and a thermally insulated foam interior body;

wherein the thermally insulated foam interior body is sandwiched between the inner lid and the outer lid;

wherein the outer lid further includes a plurality of recessed cup holders;

wherein the plurality of recessed cup holders further comprise sidewalls extending through the outer lid and into the thermally insulated body;

wherein the plurality of recessed cup holders are disposed above a top face of the inner lid;

a submersible internal circulating pump disposed within the interior volume; and a system of copper tubing disposed within the lid in proximity to the plurality of recessed cup holders and in fluid connection with the submersible internal circulating pump, whereby the submersible internal circulating pump transports a liquid through the system of copper tubing to transfer heat from a beverage container disposed within the plurality of recessed cup holders.

2. The cooler of claim 1, wherein the lid is hingedly connected to at least one sidewall extending upwardly from the base via a plurality of fasteners.

3. The cooler of claim 1, wherein the lid is secured to the plurality of sidewalls extending upwardly from the base via a locking mechanism, wherein the locking mechanism comprises a latch.

4. The cooler of claim 1, wherein the submersible internal circulating pump is disposed on the base and operably connected to an intake hose.

5. The cooler of claim 1, wherein the submersible internal circulating pump is connected to a power supply.

6. The cooler of claim 5, wherein the power supply is connected to a power port.

7. The cooler of claim 1, wherein the system of copper tubing further comprises a copper intake tube and a copper discharge tube.

8. The cooler of claim 7, wherein an intake hose is operably connected to the submersible internal circulating pump, the intake hose coupled with the copper intake tube.

9. The cooler of claim 8, wherein the submersible internal circulating pump transports the liquid from the interior volume into the system of copper tubing via the intake hose and the copper intake tube.

10. The cooler of claim 7, wherein the copper discharge tube returns the liquid from the system of copper tubing back into the interior volume, via a discharge hose operably connected to the copper discharge tube.

11. The cooler of claim 1, wherein the system of copper tubing extends through the inner lid and coils around an interior of the sidewalls of the plurality of recessed cup holders and the thermally insulated foam interior body.

12. The cooler of claim 11, wherein the beverage container disposed within the plurality of recessed cup holders is in direct thermal contact with the system of copper tubing.

13. The cooler of claim 1, wherein the system of copper tubing comprises a single length of tubing comprising a plurality of coils defined in sequence between a copper intake tube and a copper discharge tube, wherein the copper intake tube and the copper discharge tube extend through the inner lid.

* * * * *